United States Patent [19]

Richards et al.

[11] 4,025,248

[45] May 24, 1977

[54] RADIALLY EXTENDED VAPOR INLET FOR A ROTARY MULTIVANED EXPANDER

[75] Inventors: William D. C. Richards, King of Prussia; James L. Lilly, Stratford; Lawrence E. Gray, Audubon, all of Pa.

[73] Assignee: General Electric Company, Fairfield, Conn.

[22] Filed: June 16, 1975

[21] Appl. No.: 587,427

[52] U.S. Cl. ..... 418/184

[51] Int. Cl.[2] ..... F01C 21/12

[58] Field of Search ..... 418/183, 184, 98

[56] References Cited

UNITED STATES PATENTS

| | | | |
|---|---|---|---|
| 577,304 | 2/1897 | June | 418/184 |
| 1,102,742 | 7/1914 | Hauer | 418/183 |
| 1,211,169 | 1/1917 | Kells | 418/98 X |
| 2,037,351 | 4/1936 | Terrill | 418/184 |
| 2,222,689 | 11/1940 | Schott | 418/184 X |
| 3,422,726 | 1/1969 | Gottlieb | 418/183 X |

*Primary Examiner*—Carlton R. Croyle
*Assistant Examiner*—Leonard Smith
*Attorney, Agent, or Firm*—Raymond H. Quist; Allen E. Amgott

[57] ABSTRACT

The rotor of the expander has axially extending slots containing vanes which reciprocate generally radially as the rotor turns since the rotor is eccentrically mounted in a casing. Vapor distribution ports extend from the base of each slot to the surface of the rotor forward of the slot. Axial passages for admitting pressurized, high temperature vapor from the ends of the rotor intersect with the vapor distribution ports at a point between the ends of the ports.

Annular bearing elements are contained in the endwalls and lubricating oil is provided directly to them.

4 Claims, 6 Drawing Figures

RADIALLY EXTENDED VAPOR INLET FOR A ROTARY MULTIVANED EXPANDER

BACKGROUND OF THE INVENTION

1. Field of the Invention

This invention relates to expander type prime movers and more particularly vane type rotary expanders.

2. Description of the Prior Art

In the past, most multivane rotary expanders (hereafter called expanders) have used a compressed gas such as low temperature air as a motive fluid. See for example *Machine Design* for Sept. 14, 1972, page 218. As this article points out, there are definite limitations in achieving increased torque in such an expander.

Using as the motive fluid a high temperature and high pressure vaporized liquid such as water or hydrocarbon fluids, while increasing the possible power for an expander of a particular size, introduces unusual problems because of the attendant increases in temperature and pressure. One such problem is internal leakage of the vapor. Ideally, when the vapor is introduced between adjacent vanes it will be confined in this space by the rotor, casing and the endwalls. In practice, however, the vapor escapes from between the vanes, when it is admitted shortly after top dead center, to the low pressure region before top dead center. The pressurized vapor tends to force the following vane down into the slot and blow by it back to the exhaust port. The vapor also tends to flow around the ends of the rotor back toward the exhaust ports and radially inward to flow along the shafts to the low pressure exhaust manifold.

One proposed solution to this problem involves admitting the high temperature and high pressure vapor at the base of the vane slot so that the pressure helps to force the vane outwardly (see copending patent application Ser. No. 536,090, filed Dec. 24, 1974). Vapor then proceeds radially outwardly in passages behind the vanes.

An additional problem existed, however, in a prototype being developed, since for lubrication purposes oil was mixed with the vapor which cooled the vapor and heated the oil.

SUMMARY OF THE INVENTION

In a preferred form of the invention, the rotor of a rotary multivaned expander is provided with vapor distribution ports which extend from the base of the vane slots to the surface of the rotor. Axial passages extend in from the ends of the rotor to the vapor distribution ports at a point near the center of the vapor distribution ports. Annular thrust bearing elements are contained in the endwalls and lubrication oil is provided directly to them.

DESCRIPTION OF THE PREFERRED EMBODIMENT

Figure 1:
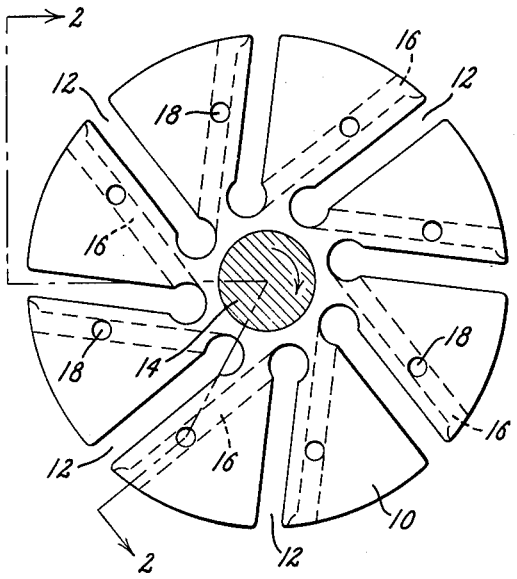
FIG. 1 is a cross-section of a rotor in accordance with the invention.
Figure 2:
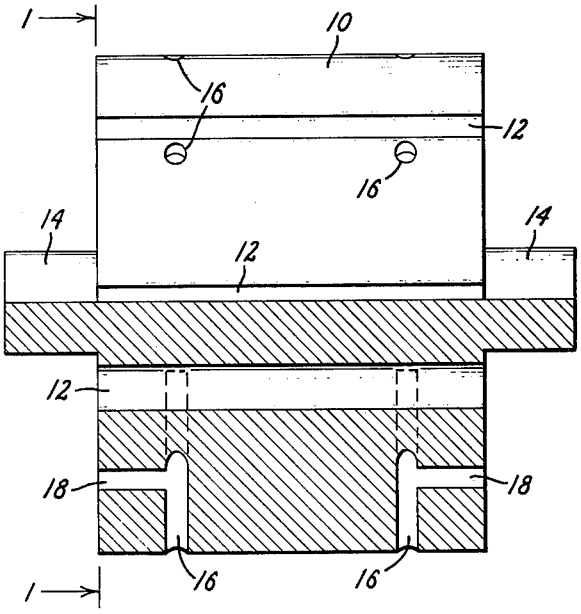
FIG. 2 is an elevation, partially in section of the rotor.

Referring to FIGS. 1 and 2, rotor 10 is shown having a plurality of axially extending slots 12 which are intended to contain vanes which will reciprocate as the rotor turns. Shaft 14 is provided to support the rotor and act as a means for providing the power generated to other devices.

In accordance with the invention, a plurality of vapor distribution ports 16 are provided which extend between the base of each slot 12 and the surface of rotor 10. It will be noted that the vapor distribution port leading to the base of a particular slot intersects with the surface at a location forward of the slot in the direction of rotation. Passages 18 extend axially inwardly from the the ends of the rotor to the vapor distribution ports. Rather than have a vapor admitted at the base of the slots as in some prior art expanders, passages 18 admit the vapor to the vapor distribution ports at a point between the ends of the vapor distribution ports and preferably near the center of the vapor distribution ports. The purpose of this location will be discussed later.

Figure 3:
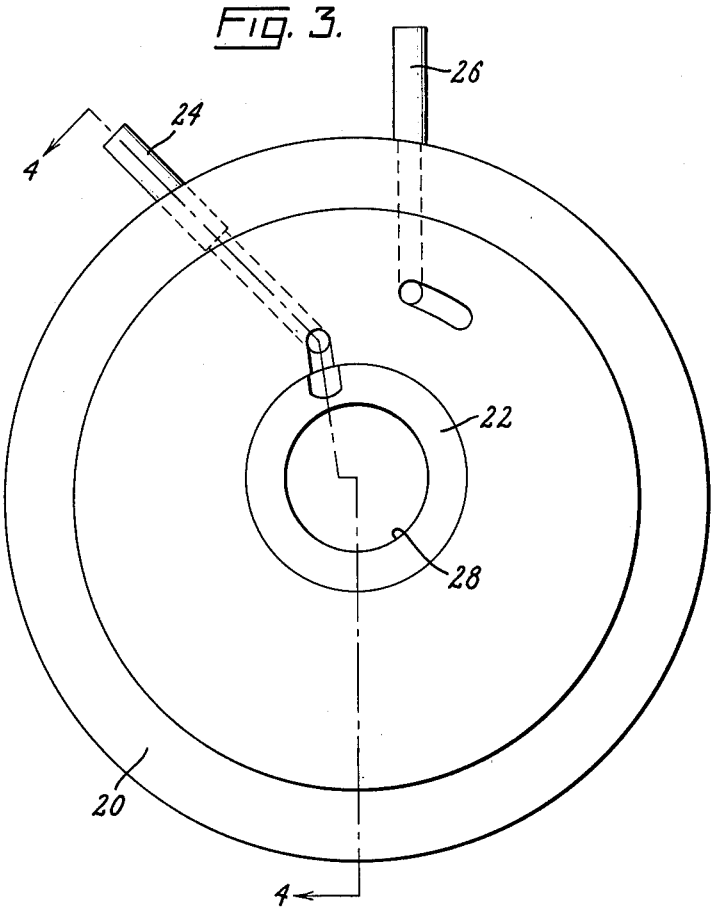
FIG. 3 is an elevation of an endwall of the expander.
Figure 4:
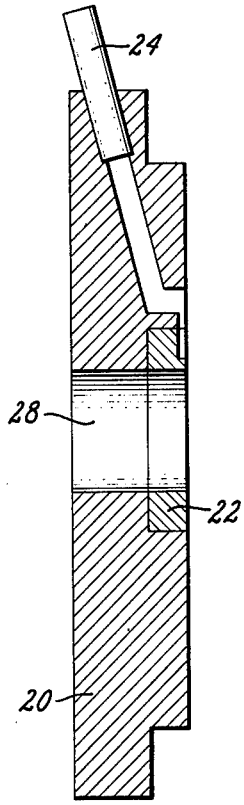
FIG. 4 is a cross-section of the endwall.

Turning next to FIGS. 3 and 4, endwall 20 is illustrated. A mirror image of the endwall would also be provided for the opposite end of the expander. Annular thrust bearing element 22 is provided to be the only point of contact between the ends of rotor 10 and endwall 20. A corrosion resistant steel with a ceramic coating on the bearing face has been found to be satisfactory. Bearing element 22 is made eith flush with the endwall surface or slightly above it, approximately $5 \times 10^{-6}$ meters ($2 \times 10^{-4}$ inches). To minimize wear, oil supply means 24 is provided to bring lubricating oil directly to bearing element 22. Pressurized vapor is carried through passage 26 to opening on the inner surface of endwall 20 which will be adjacent to passages 18 of rotor 10 as they reach this point in their rotation. The opening in endwall 20 is made somewhat arcuate to permit sufficient vapor to be admitted. Opening 28 through endwall 20 is provided for shaft 14 of rotor 10. Although perhaps not completely apparent in FIGS. 3 and 4, opening 28 is not centrally located in endwall 20.

Figure 6:
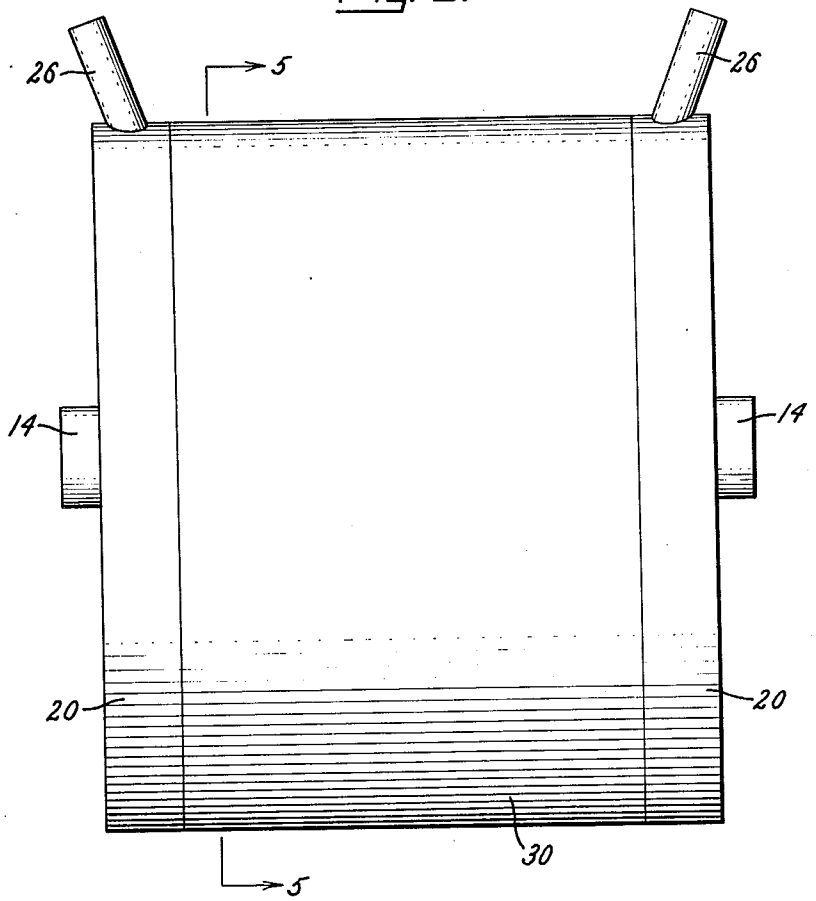
FIG. 6 is an elevation of the expander.
Figure 5:
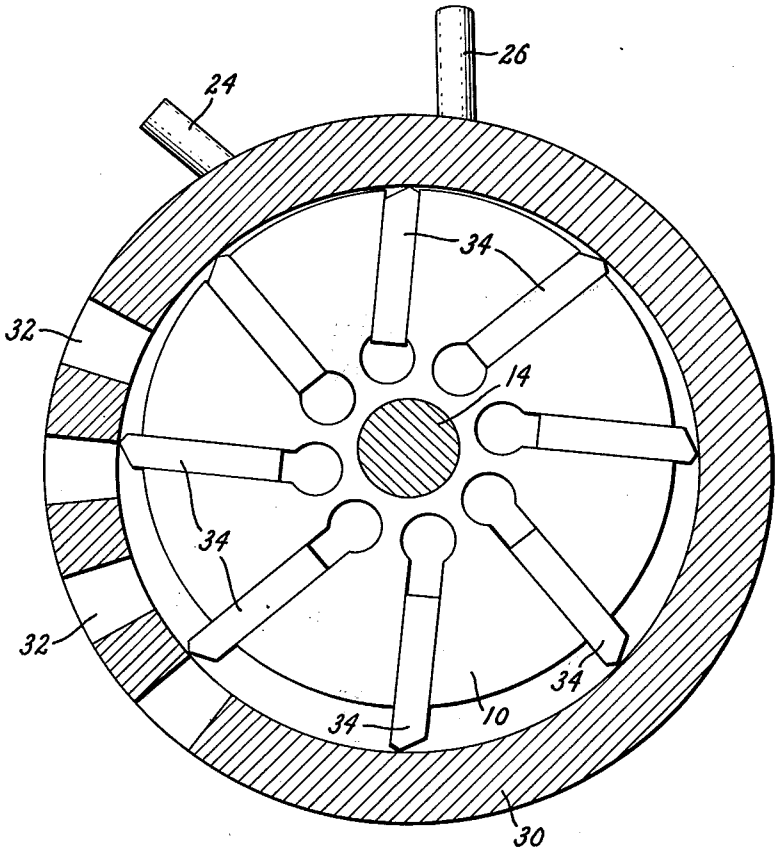
FIG. 5 is a cross-section of the casing and rotor shaft showing the vanes in the slots.

Turning next to FIGS. 5 and 6, rotor 10 is shown mounted in casing 20. Casing 30 is a circular cylinder having a plurality of exhaust ports 32. The slots of rotor 0 are shown in FIG. 5 containing vanes 34.

As rotor 10 turns due to the pressure of the vapor on vanes 34, centrifugal force tends to force vanes 34 out against casing 30. This outward force tends to be resisted by the pressure of the vapor on the tops of the vanes. Vapor distribution ports 16 provide vapor to the base of the slots which adds to the outwward force on the vanes.

There are additional advantages to this design over previous arrangements. Previously the lubricating oil was mixed with the vapor which tended to quench the vapor. The lubricating oil now remains cooler, and the vapor remains hot. Also the distance between the vapor inlet in endwalls 20 and the low pressure exhaust ports is increased, reducing vapor leakage to the exhaust ports between the endwalls and the rotor as well as leakage back over the vanes. Previous designs had the inlet arcs supplied by passages 26 radially closer to shafts 14 with 55% of vapor inlet arc on the exhaust side of the top dead center location. In addition, the radially extended axial passage 18 both shortens and simplifies the path the vapor must follow. This change in the location of the vapor feed arc has significantly simplified the carbon graphite vane configuration thereby reducing manufacturing costs and providing increased life. No longer is it required to notch the bottom corner of the vanes nor provide a chamfer along each side of the vane for sealing purposes. With the notched corners deleted, the stress concentrations resulting from the geometry have been eliminated. As a result, vane breakage has been reduced.

Utilization of rotor thrust bearing inserts has increased performance, increased the operation life of the expander and provided reduced refurbishing costs should the bearing faces become damaged. Performance has been increased in that there is less distortion of the bearing clearances, the lubricating qualities of the lube oil are inhanced due to the colder supply temperature and the independent lube supply directly into the rotor thrust bearing clearances. In total, the level of friction has been reduced. Life of the expander has been extended because the ceramic thrust bearing face material is now applied to a high corrosion resistant steel. This material has identical thermal expansion characteristics as the previously used ductile cast iron but has twice the base material hardness. Thus, the corrosion of the base material by the working fluid has been eliminated and the ceramic bearing face material has increased support via the harder substrate.

Although a specific embodiment of a rotary multivaned expander has been illustrated and described, it will be obvious that changes and modifications can be made without departing from the spirit of the invention or the scope of the appended claims.

We claim:

1. In a rotary multivaned expander having a rotor with axially extending slots containing vanes free to reciprocate, said rotor eccentrically mounted in a casing and confined by endwalls, the improvement comprising:

vapor distribution ports exending between the base of each slot and the surface of said rotor forward of said slot; and passages for admitting vapor axially inwardly from the ends of said rotor to said vapor distribution ports at a location between the ends of said vapor distributionn ports.

2. A rotary vaned expander in accordance with claim 1 further including:

annular thrust bearing elements contained in said endwalls; and lubrication means for providing lubricant to said thrust bearing elements.

3. A rotary multivaned expander comprising:

a rotor having a plurality of axially extending slots and centrally located shafts extending from each end;

a vane contained in ech of said slots and free to reciprocate in said slots;

a casing surrounding said rotor, against the inner surface of which the vane tips ride;

endwalls each having a non-centrally located opening for receiving said shafts;

a pair of vapor distribution ports extending from the base of each slot to the surface of the rotor forward of the slot; and passages for admitting vapor axially inwardly from the ends of said rotor to said distribution ports at a location between the ends of said vapor distribution ports.

4. A rotary multivaned expander in accordance with claim 3 wherein:

the passages for admitting vapor to the vapor distribution ports intersect said vapor distribution ports near the center.

* * * * *